US009668562B2

(12) United States Patent
Lee

(10) Patent No.: US 9,668,562 B2
(45) Date of Patent: Jun. 6, 2017

(54) AIRLESS COSMETIC CONTAINER CAPABLE OF DISCHARGING COSMETIC PRODUCT CONTENT IN VARIOUS PATTERNS

(71) Applicant: PUM-TECH KOREA CO., LTD, Incheon (KR)

(72) Inventor: Do Hoon Lee, Incheon (KR)

(73) Assignee: Pum-Tech Korea Co., LTD, Bupyeong-gu, Incheon (KR)

( * ) Notice: Subject to any disclaimer, the term of this patent is extended or adjusted under 35 U.S.C. 154(b) by 0 days.

(21) Appl. No.: 14/784,924

(22) PCT Filed: Apr. 16, 2014

(86) PCT No.: PCT/KR2014/003292
§ 371 (c)(1),
(2) Date: Oct. 15, 2015

(87) PCT Pub. No.: WO2014/171725
PCT Pub. Date: Oct. 23, 2014

(65) Prior Publication Data

US 2016/0073762 A1 Mar. 17, 2016

(30) Foreign Application Priority Data

Apr. 18, 2013 (KR) ..... 20-2013-0003002 U

(51) Int. Cl.
*A45D 34/00* (2006.01)
*B05B 11/00* (2006.01)
(Continued)

(52) U.S. Cl.
CPC ..... *A45D 34/00* (2013.01); *A45D 34/04* (2013.01); *B01F 15/0087* (2013.01);
(Continued)

(58) Field of Classification Search
CPC .. A45D 2200/056; A45D 34/00; A45D 34/04; A45D 40/24; B01F 15/0087;
(Continued)

(56) References Cited

U.S. PATENT DOCUMENTS 5,224,627 A * 7/1993 Weag ..... B05B 11/0048 222/135
8,608,029 B2 * 12/2013 Lee ..... A45D 34/00 222/135
2001/0025860 A1 * 10/2001 Auer ..... B05B 11/3029 222/137
2004/0188464 A1 * 9/2004 Auer ..... B05B 11/0064 222/135
2008/0110930 A1 * 5/2008 Wittkamp ..... A45D 19/02 222/135
2011/0315574 A1 * 12/2011 Lee ..... A45D 34/00 206/219
(Continued)

FOREIGN PATENT DOCUMENTS

KR 10-0359486 B1 10/2002
KR 10-1037361 B1 5/2011
(Continued)

*Primary Examiner* — Frederick C Nicolas
*Assistant Examiner* — Bob Zadeh
(74) *Attorney, Agent, or Firm* — East West Law Group; Heedong Chae

(57) ABSTRACT

The present invention relates to an airless cosmetic container capable of discharging cosmetic product content in various patterns, and more particularly, an airless cosmetic container for enabling a user to select a cosmetic product content inside two storage containers provided inside a cosmetic container body and discharge content from only one container, or for allowing dispersed discharge through discharge holes from a mixing member when two types of cosmetic product contents are discharged simultaneously, thereby allowing the user to apply makeup with a single push. The discharge holes formed through the mixing member may be formed into various patterns to allow the cosmetic product content, to be discharged into various patterns, thereby providing aesthetic impression to consumers.

5 Claims, 14 Drawing Sheets

(51) Int. Cl.

| | |
|---|---|
| ***A45D 34/04*** | (2006.01) |
| ***B01F 15/00*** | (2006.01) |
| ***B01F 15/02*** | (2006.01) |
| *A45D 40/24* | (2006.01) |

(52) U.S. Cl.
CPC ..... *B01F 15/0227* (2013.01); *B05B 11/0043* (2013.01); *B05B 11/0048* (2013.01); *B05B 11/3023* (2013.01); *B05B 11/3052* (2013.01); *B05B 11/3084* (2013.01); *A45D 40/24* (2013.01); *A45D 2200/056* (2013.01)

(58) Field of Classification Search
CPC ..... B01F 15/0227; B05B 11/0043; B05B 11/0048; B05B 11/3023; B05B 11/3052; B05B 11/3084
See application file for complete search history.

(56) References Cited

U.S. PATENT DOCUMENTS

2016/0073762 A1* 3/2016 Lee ..... A45D 34/04
222/145.6

FOREIGN PATENT DOCUMENTS

KR 20-0460321 Y1 5/2012
KR 10-1182225 B1 9/2012
KR 10-1242196 B1 3/2013

* cited by examiner

PRIOR ART

PRIOR ART

PRIOR ART

PRIOR ART

PRIOR ART

AIRLESS COSMETIC CONTAINER CAPABLE OF DISCHARGING COSMETIC PRODUCT CONTENT IN VARIOUS PATTERNS

TECHNICAL FIELD

The present invention relates to an airless cosmetic container capable of discharging cosmetic product content in various patterns, and more particularly, to an airless cosmetic container for enabling a user to select a cosmetic product content inside two storage containers provided inside a cosmetic container body and discharge content from only one container, or for allowing dispersed discharge through discharge holes from a mixing member when two types of cosmetic product contents are discharged simultaneously, thereby allowing the user to apply makeup with a single push. In addition, the discharge holes formed through the mixing member may be formed into various patterns to allow the cosmetic product content to be discharged into various patterns, thereby providing aesthetic impression to consumers.

BACKGROUND ART

In the case of cosmetic products in liquid forms or gel forms having low viscosity such as lotion, cream, gel, shampoo, rinse, etc., an airless pump is provided in a cosmetic container such that the content may be easily discharged.

The cosmetic container accommodating the cosmetic product having the coefficient of viscosity is designed to discharge the accommodated feed content small amounts at a time, and specifically, is employed to many containers that accommodate functional cosmetic products.

In addition, the airless pump employed to the cosmetic container is also used in a different content mixing cosmetic container for mixing and discharging two types of contents having mutually different components. In other words, there are products, which are types of functional cosmetic products, in which its effects are improved when contents having mutually different components are mixed, and the airless pump may be installed on the functional cosmetic container to discharge the content.

A typical different content, mixing cosmetic container is disclosed in Korean Unexamined Utility Model Publication No. 20-2008-0002044 (published on Jun. 23, 2008). FIGS. 1 and 2 show the different content mixing cosmetic container, which mix and discharge two contents having different components, and as shown, the typical different content mixing cosmetic container 10 includes a container body 11, airless pumps 12*a* and 12*b*, pistons 13*a* and 13*b* and a push button 14.

An inner space of the container body 11 is divided into two storage parts 11*b* and 11*c* by a wall, and two contents having mutually different components are filled into each of the storage parts, respectively, and the airless pumps 12*a* and 12*b* are installed at upper parts of the two storage parts 11*a* and 11*b*, respectively.

The pistons 13*a* and 13*b* are installed in the two storage parts 11*a* and 11*b* of the container body 11, respectively, the pistons 13*a* and 13*b* move up in association with the operation of the airless pumps 12*a* and 12*b* inside the storage parts 11*a* and 11*b*, and the pistons 13*a* and 13*b* that move up push the contents in the storage parts 11*a* and 11*b* upward.

The push button 14 is installed at an upper part of the airless pumps 12*a* and 12*b* to pressurize the airless pumps 12*a* and 12*b*, and the push button is configured to discharge the two contents discharged from the two storage parts 11*a* and 11*b* of the container body 11.

Referring to FIG. 2, when observing the operation of the typical different content mixing cosmetic container configured as described above, first, when the push button 14 is pushed to pump the airless pumps 12*a* and 12*b* disposed at the storage parts 11*a* and 11*b*, respectively, pressure is generated inside pump cylinders 18*a* and 18*b* and, simultaneously, content transfer paths of piston rods 16*a* and 16*b* are secured, so the contents filled inside the pump cylinders 18*a* and 18*b* axe discharged through the discharge holes 14*a* and 14*b* after passing through, the discharge tubes 15*a* and 15*b* of the push button 14.

When the external force applied to the push button 14 is removed after the content is discharged, the piston rods 16*a* and 16*b*, to which repulsive forces of springs 17*a* and 17*b* are applied, move up to the original position, and, in this case, vacuum pressure is generated inside the pump cylinders 18*a* and 18*b* such that open and close balls blocking the inserting holes 19*a* and 19*b* become separated, so the contents in the storage parts 11*a* and 11*b* become filled inside the pump cylinders 18*a* and 18*b*.

Through the process described above, the contents having mutually different components accommodated in the two storage parts 11*a* and 11*b* of the container body 11 are discharged and used.

However, because, in the typical different content mixing cosmetic container, the discharge holes are provided at side surfaces of the push button and the contents are discharged through the discharge holes of the push button, which move while the push button is operated, the contents are frequently dropped to the floor, so resources are wasted and the surrounding environment becomes unclean. In addition, after the two contents are discharged, a separate mixing container is required to be used to mix the two contents. Further, because, in the typical cosmetic container, the entire cosmetic container needs to be held by the hand and the posh button, disposed at the upper part of the cosmetic container needs to be pushed by the finger to discharge the cosmetic contents, the typical cosmetic container is very inconvenient for women having small hands to use.

Therefore, as described above, solutions for the structural problem of the discharge holes provided at the side surfaces and the problem of requiring the separate mixing container after the two contents are discharged are demanded. Another different content mixing cosmetic container proposed according to the demand is disclosed in the Korean Registered Patent No. 1037361, FIGS. 3 to 5 show the different content mixing cosmetic container for discharging two different contents having mutually different components, a pair of storage containers 400 and 400', in which cosmetic contents are accommodated, are provided at an outer container 300, lower pistons 411 and 411', which move up whenever the cosmetic contents are consumed, are provided at lower parts of the storage containers 400 and 400', upper pistons, which may discharge the cosmetic contents, are provided at opening parts ox the storage containers 400 and 400', piston rods 430 and 430', which move down by pressure nations of the pair of buttons 200 and 200', are provided at the upper pistons, and cosmetic discharging parts 120 and 120', which discharge the contents pumped by the up and down operation of the piston rods 430 and 430', in which the cosmetic discharging parts 120 and 120' are coupled to the rubber tip 140 coupled to an inclined mixing part 110.

When the buttons 200 and 200' are pressed, the coupling pieces integrated to the buttons move the piston rods 430 and 430' downward, and the cosmetic contents in the storage containers 400 and 400' are discharged to the mixing part 110 through the cosmetic discharging parts 120 and 120' when the check valves 451 and 451' are opened from the downward movement of the piston rods 430 and 430'.

However, the cosmetic contents transferred through the path of the cosmetic discharging parts 120 and 120' are discharged to the mixing part 110 such that the two cosmetic contents are mixed and used, and the cosmetic discharging parts 120 and 120' are vertically penetrated, so the cosmetic contents shoot up like a fountain and drop near the cosmetic container due to the high pressure of the cosmetic contents.

In addition, after the cosmetic contents are discharged from the cosmetic discharging parts 120 and 120', mixed in the mixing part 110 and used, leftovers of the cosmetic contents remain in the space between the mixing part 110, so skin troubles may occur.

DISCLOSURE

Technical Problem

The present invention is provided to solve the described problems, an object is to dispersedly discharge the cosmetic product contents by multiple discharge holes formed as small holes through the mixing member accommodating the discharged cosmetic product contents when the cosmetic product contents of the two storage containers provided in the cosmetic container body are discharged by an operation of an airless pump, such that a user may discharge the cosmetic product contents sufficient enough for wearing cosmetic products on the face by a single push, thus solving the inconvenience of discharging and mixing the cosmetic product contents by multiple push operations in the mixing member to wear cosmetics on the face.

In addition, an object is to guide the cosmetic product contents to multiple discharge holes to dispersedly discharge the cosmetic product contents after primarily blocking the cosmetic product contents moving upward by a high pressure due to the operation of the airless pump, so that the cosmetic product contents may be prevented from shooting upward like a fountain by the high pressure and dropping near the cosmetic container, thereby preventing waste.

In addition, the multiple discharge holes provided through the mixing member may be formed into various patterns so that the cosmetic product contents are discharged in various patterns, thereby providing aesthetic impression to consumers.

Further, because the discharged cosmetic product contents are mixed on the mixing member when the cosmetic product contents of the two storage containers are discharged by the operation of the airless pump, even without using a separate mixing container as in the prior arts, the two discharged cosmetic product contents may be mixed at an tipper part of the mixing member disposed at an upper part of the cosmetic container and used.

In addition, an object of the present invention is to provide the cosmetic container, in which the two contents are easily discharged to the upper part of the cosmetic container by pressing the side surfaces of the cosmetic container by fingers, so that women having small hands may easily use the cosmetic container.

Technical Solution

The cosmetic container of the present invention to achieve the objects includes:

first and second storage containers (V1 and V2), in which cosmetic product contents are accommodated, an airless pump (P) provided at an opening part of the first and second storage containers (V1 and V2) to discharge the cosmetic product contents, a container body (110), to which a lower cap (C) is coupled, to accommodate the first and second storage containers (V1 and V2), a shoulder (120) coupled to an upper part of the container body (110) and having a button accommodating groove (122) to accommodate a side button (121) such chat the side button (121) moves back and forth, and a content discharging device (130) provided at the shoulder (120) to primarily block the cosmetic product contents moving upward due to a high pressure by an operation of the airless pump (P) and guide the cosmetic product contents to multiple discharge holes (134) such that the cosmetic product contents are dispersedly discharged.

Advantageous Effects

In the present invention, the cosmetic product contents are discharged to the mixing member provided at an upper part of the shoulder when the cosmetic product contents are discharged from the cosmetic container and dispersedly discharged through multiple discharge holes provided through the mixing member, so that the consumer may wear the cosmetic product from the discharged cosmetic product contents by pushing once, thereby solving the inconvenience of discharging and mixing the cosmetic product contents by multiple pushing operations as in the prior arts. In addition, the multiple discharge holes provided through the mixing member may be formed into various patterns so that the cosmetic product contents are discharged in various pattern, thereby providing aesthetic impression to consumers. In addition, the cosmetic product contents are guided to multiple discharge holes to discharge the cosmetic product contents after primarily blocking the cosmetic product contents moving upward by the high pressure due to the operation of the airless pump, so that the cosmetic product contents may be prevented from shooting upward like a fountain by the high pressure and dropping near the cosmetic container, thereby making the surrounding environment for wearing the cosmetic products clean. In addition, after the two cosmetic product contents are discharged, even without using a separate mixing container, the two cosmetic product contents discharged from the mixing member may be mixed and used.

In addition, the two contents are easily discharged to the upper part of the cosmetic container by pressing the side surfaces of the cosmetic container by fingers, so that women having small hands may easily use the cosmetic container.

BEST MODE

Mode for Invention

Hereinafter, the present invention is described in detail in reference to the accompanying drawings.

Figure 1:
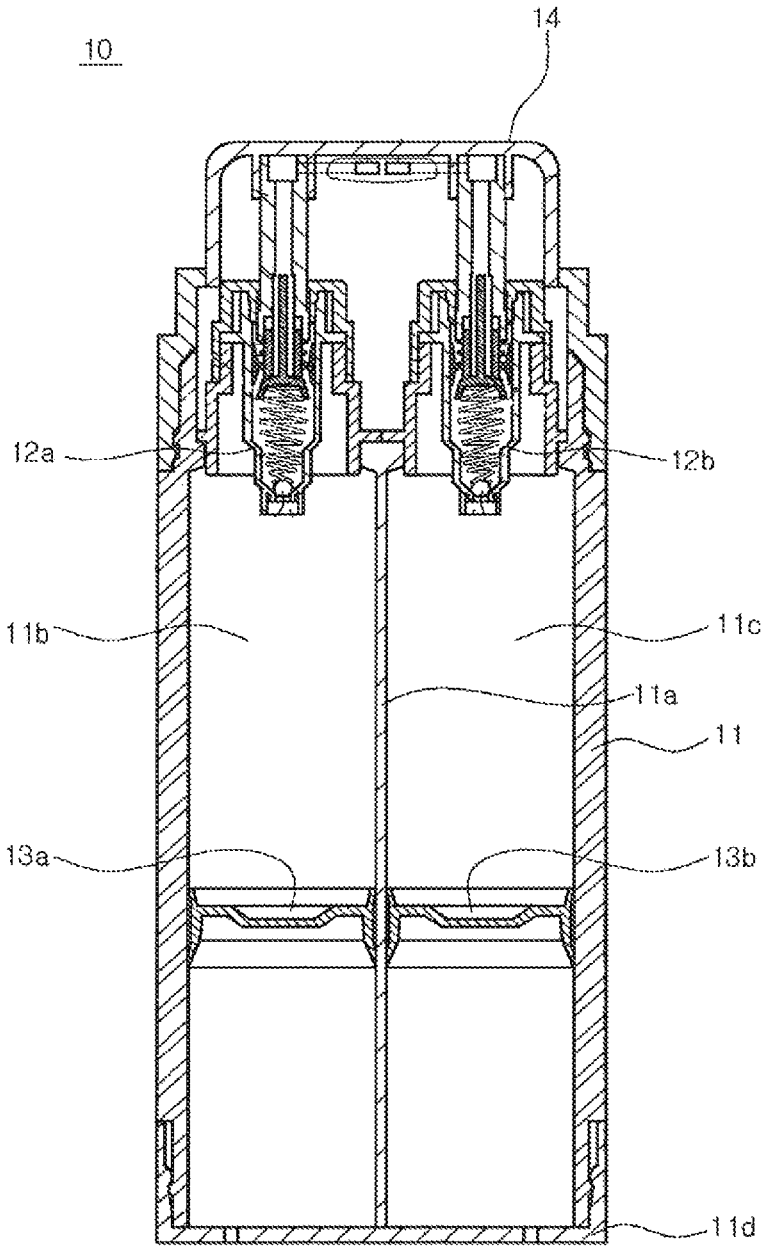
FIGS. 1 and 2 are a sectional view showing a typical different content mixing cosmetic container and a sectional view showing a typical different content mixing cosmetic container in use, respectively.
Figure 2:
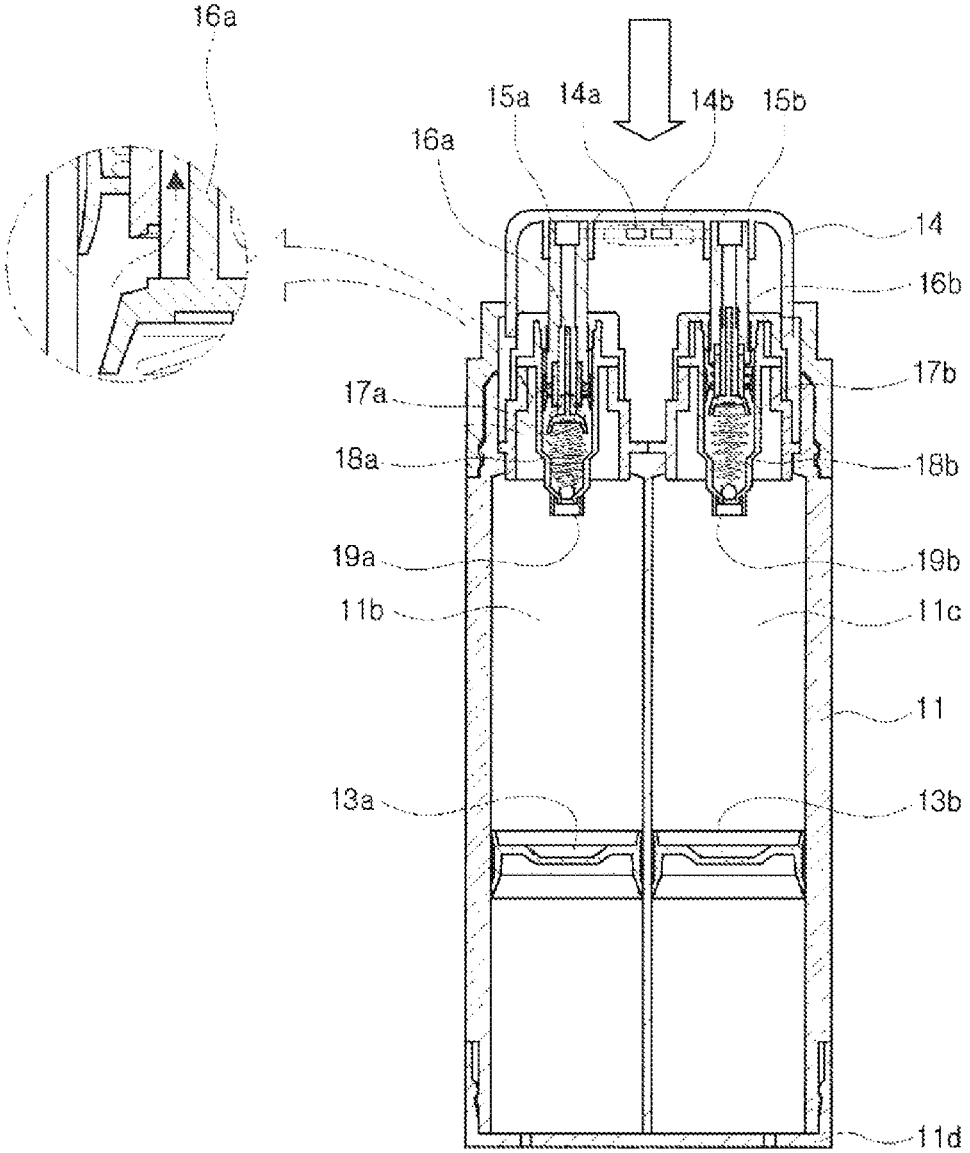
Figure 3:
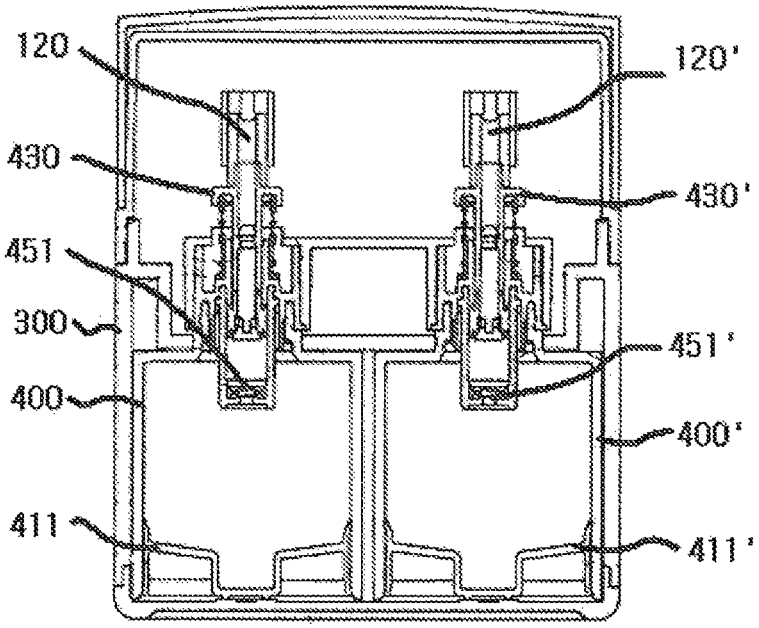
FIGS. 3 to 5 are side sectional views and a perspective view showing the typical different content mixing cosmetic container.
Figure 4:
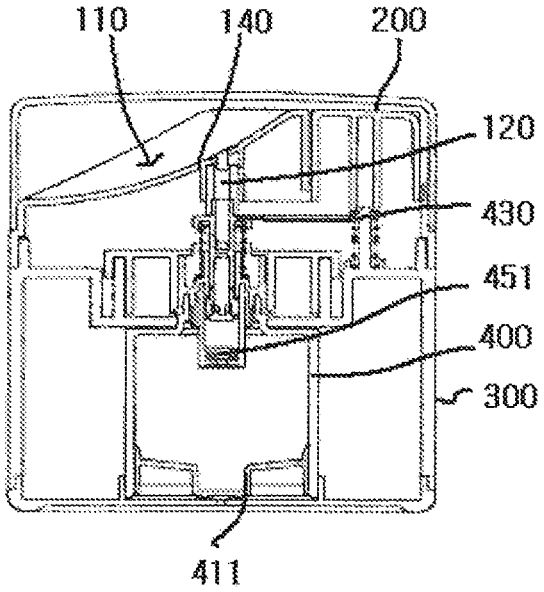
Figure 5:
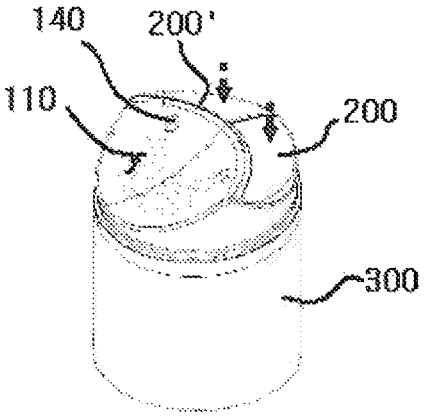
Figure 6:
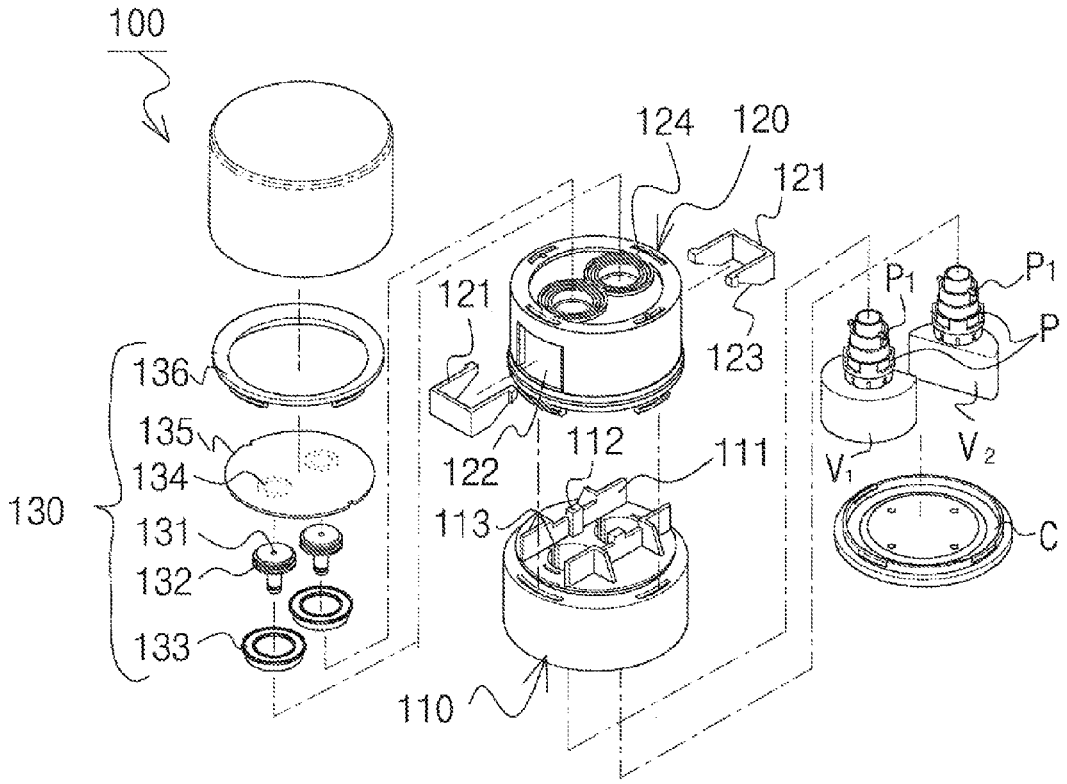
FIG. 6 is an exploded perspective view showing a cosmetic container of the present invention.
Figure 7:
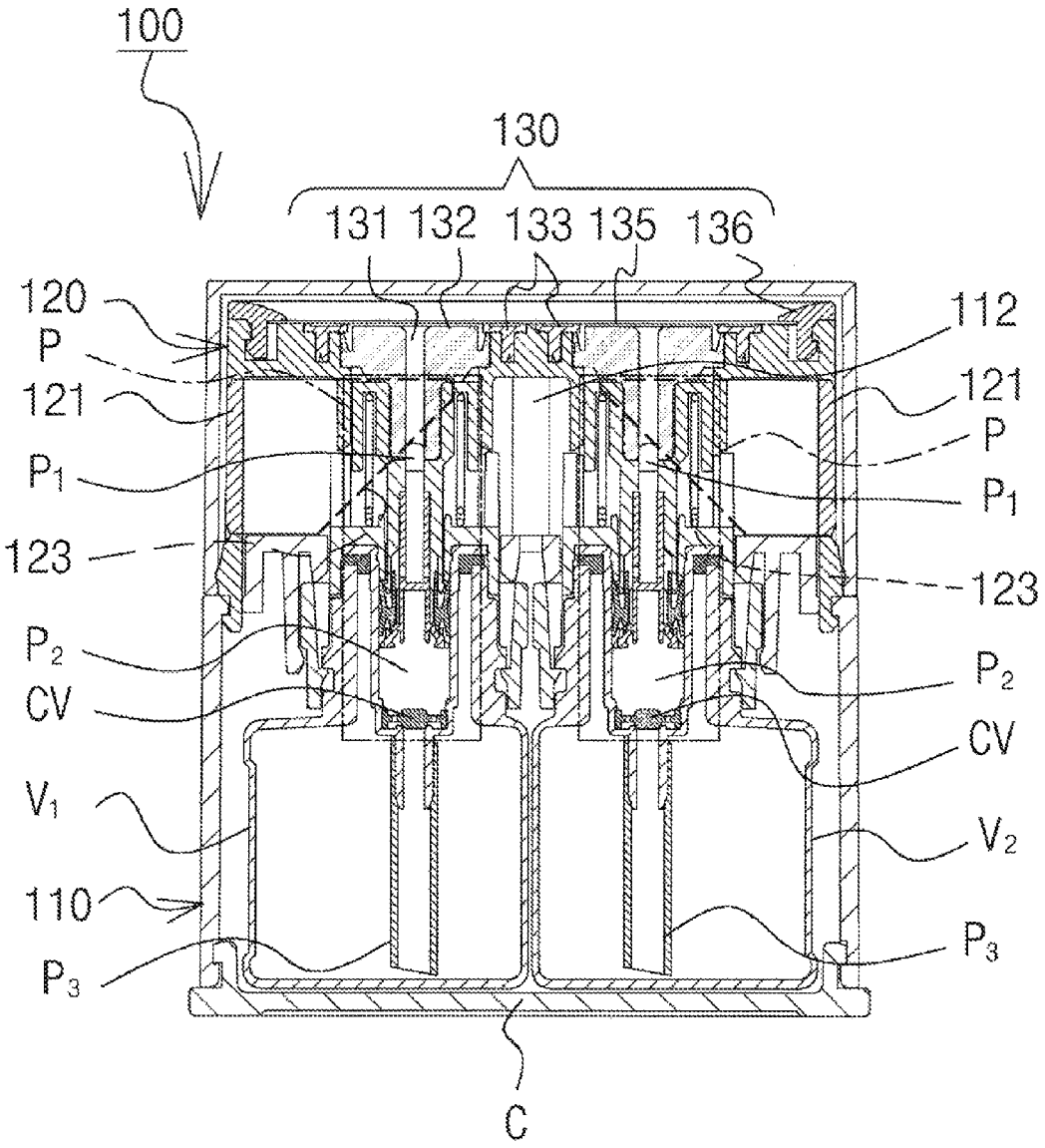
FIG. 7 is a sectional view showing the entire cosmetic container of the present invention.

First, as shown in FIGS. 6 and 7, a cosmetic container of the present invention includes:

first and second storage containers V1 and V2, in which cosmetic product contents axe accommodated, an airless pump P provided at an opening part of the first and second storage containers V1 and V2 to discharge the cosmetic product contents, a container body 110, to which a lower cap C is coupled, to accommodate the first and second storage containers V1 and V2, and a shoulder 120 coupled to an upper part of the container body 110 and having a button accommodating groove 122 to accommodate a side button 121 such that the side button 121 moves back and forth.

In addition, a pressing protrusion P1 is provided on the airless pump P to move the airless pump P up and down by a pressurization and a release of the side button 121.

In this case, a guide member 111 is provided in the container body 110 to guide the side button 121 when the side button slides on an upper part of the container body 110, in which a stopper 112 protrudes from a center part of the guide member 111 to stop the side button 121.

In addition, the pressing protrusion P1 makes contact with an inclined surface 123 of a lower side of the side button 121 and moves down by a pressurization of the side button 121 and moves up by a release of the pressurization.

Further, a guide groove 113, through which the pressing protrusion P1 passes through and installed, is provided on the container body 110.

In addition, a content discharging device 130 is provided in the shoulder 120 to primarily block the cosmetic product contents moving upward due to a high pressure by an operation of the airless pump P and guide the cosmetic product contents to multiple discharge holes 134 such that the cosmetic product contents are dispersedly discharged.

Further, the content discharging device 130 includes a content guiding member 132 coupled to an upper end of the airless pump P and having a space 131, which includes a discharge path of the cosmetic product contents, a sealing member 133 provided at an outer circumference of the content guiding member 132 and coupled to a rib 124 provided at the shoulder 120 to prevent the content guiding member 132 from breaking away and maintain a sealed state of the content, a mixing member 135 to primarily block the cosmetic product content discharged at a high pressure while maintaining a predetermined distance from an upper part of the content guiding member 132 and guide the cosmetic product content to multiple discharge holes 134 so that the cosmetic product contents are discharged, and a cover ring 136 undercut and coupled to the shoulder 120 so that the mixing member 135 is fixed to an upper part of the shoulder 120.

In this case, the mixing member 135 may include metal or plastic.

In addition, the discharge holes 134 provided through the mixing member 135 may include any one shape among a letter shape, a circular shape, a triangular shape, a pentagonal shape.

In addition, as another embodiment of the mixing member 135, a mesh 137 may be coupled to the cover ring 136 through insert injection to represent various patterns, in which the discharge holes 137*a* are open in various patterns of the mesh 137 and a paint 137*b* is coated on remaining parts of the mesh 137 to block the discharge holes.

In this case, the mesh 137 may include one of a screen and a fabric.

The operation of the present invention configured as above will be described.

Figure 8:
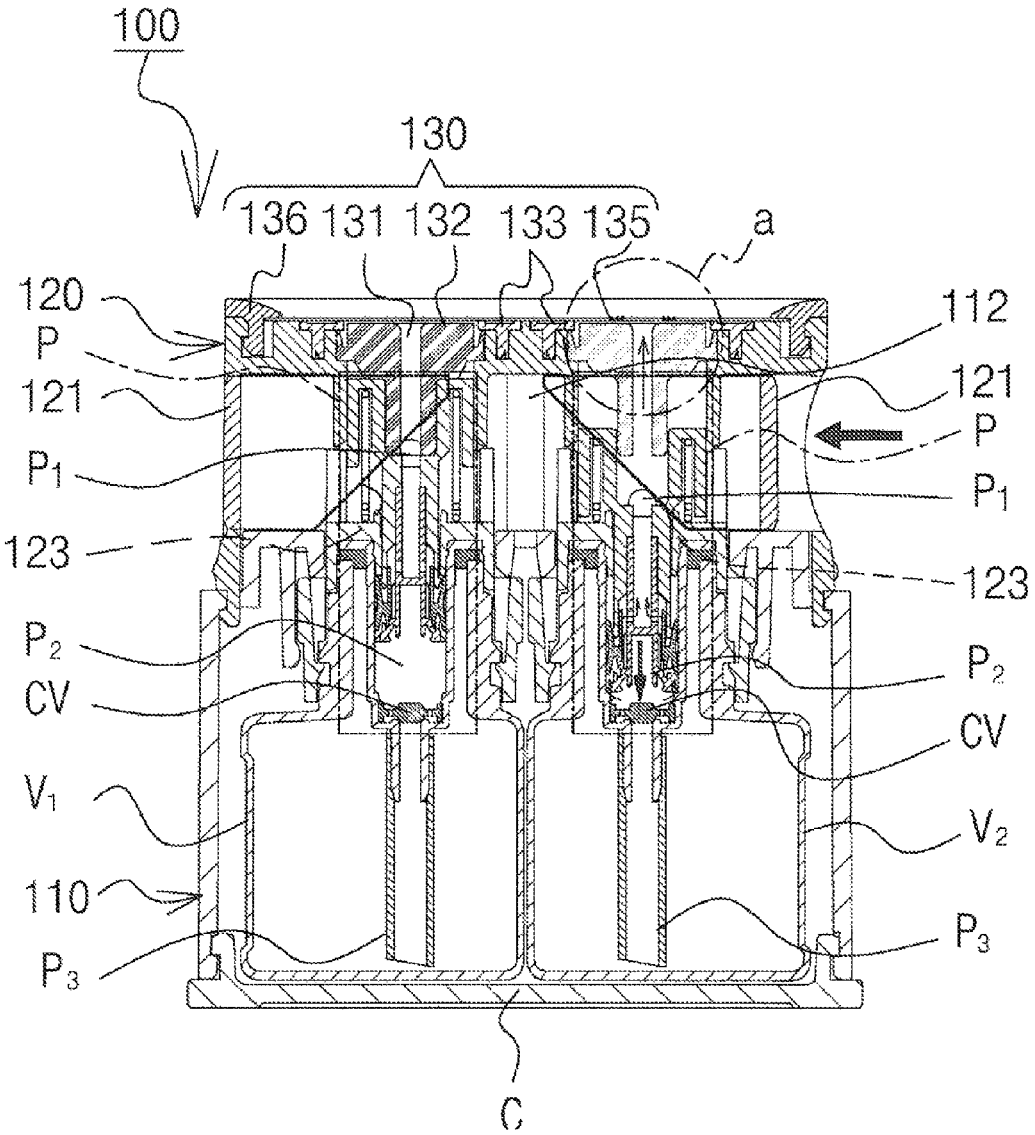
FIG. 8 is a sectional view showing a state in which one cosmetic product content is discharged by a pressurization of a side button of one side button provided in the present invention.

First, in the case of selecting and using any one among the first and second storage containers V1 and V2, as shown in FIG. 8, when the side button 121 of one side is pressed and slided into the shoulder 120 after separating an upper cover from the container body 110, the side button 121 progresses according to the guidance of the guide member 111 and the inclined surface 123 formed at a lower side of the side button 121 presses the pressing protrusion P1 protruding from an upper side of the airless pump P.

Figure 9:
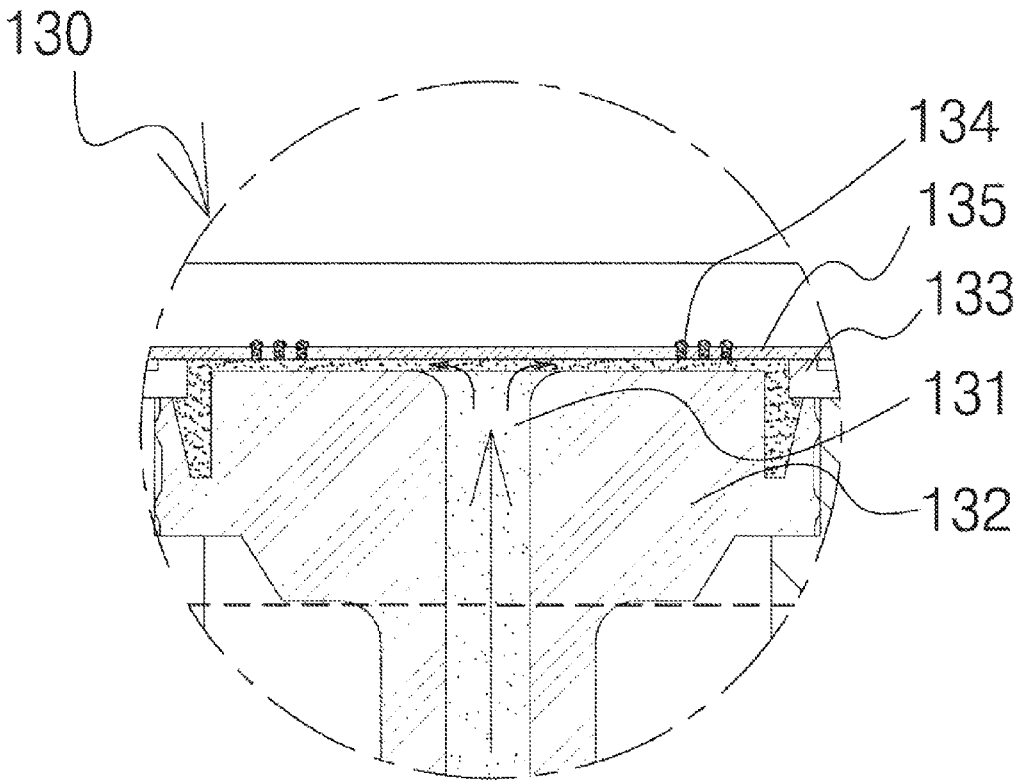
FIG. 9 is an enlarged view showing part a of FIG. 8.

Thus, the content transfer path in the airless pump P becomes open when the airless pump P moves downward and the cosmetic product contents in a temporary storage room P2 moves upward through the space 131 provided in the content guiding member 132, and as shown in FIG. 9, the cosmetic product contents moving upward by the high pressure primarily makes contact with a lower side surface of the mixing member 135 such that the cosmetic product contents are dispersed to both sides and then discharged to the outside through the multiple discharge holes 134.

Figure 10:
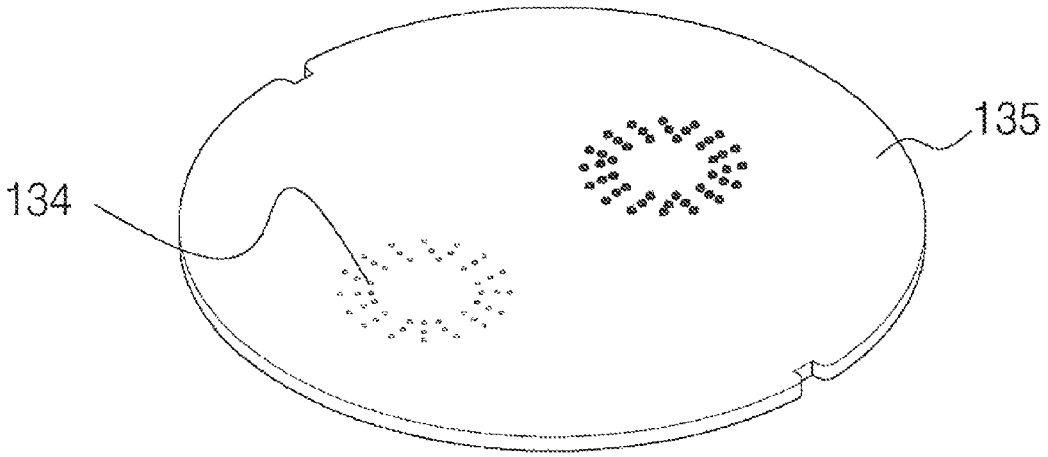
FIG. 10 is an enlarged perspective view showing a mixing member of she present invention.

In this case, because the cosmetic product contents discharged through the discharge holes 134, as shown in FIG. 10, are dispersed and arranged into multiple cosmetic product drops, the cosmetic product is dispersed and evenly coated on a puff when a user puts on the cosmetic product by a puff, thus the cosmetic product may be evenly worn.

Then, when the force pressing the side button 121 is released, the airless pump P moves upward by the spring in the airless pump P, and, simultaneously, the pressing protrusion P1 pushes the inclined surface 123 of the side button 121, so that the side button 121 is returned to the original position.

In this case, simultaneously, the content transferring path is blocked by a piston packing when the piston rod moves upward in the airless pump P, and accordingly, the cylinders in the first storage container V1 moves upward through a suction valve tube P3 when a check valve CV is opened when a vacuum pressure is generated in the cylinder in the airless pump P.

Figure 11:
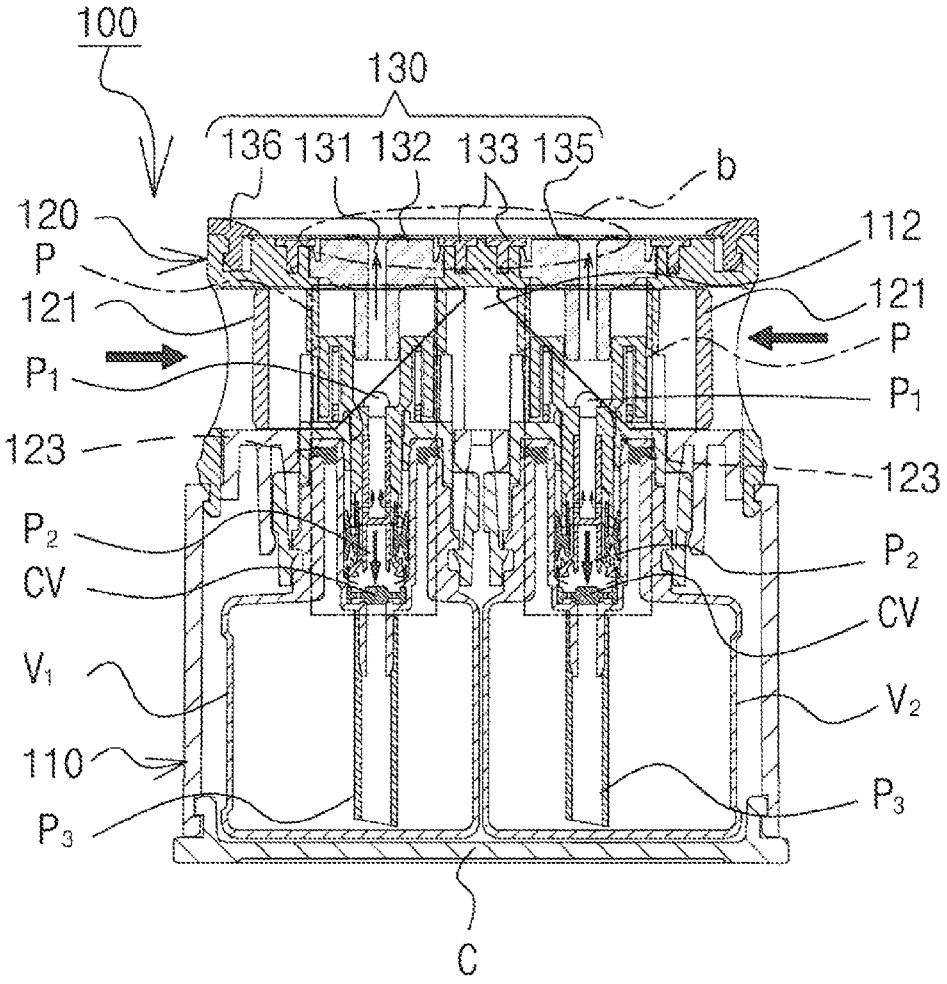
FIG. 11 is a sectional view showing a state in which two cosmetic product contents are discharged by pressurizations of side buttons of both sides provided in the present invention.

Meanwhile, when it is necessary, in use, to mix both cosmetic product contents stored in the first and second storage containers V1 and V2 by simultaneously discharging the cosmetic product contents, as shown in FIG. 11, both side buttons 121 are simultaneously pushed, and the operation of the side buttons 121 and the airless pump P is as below.

In other words, as shown in FIG. 11, when both side buttons 121 are pressed and sided into the shoulder 120, the side buttons 121 moves according to the guidance of the guide member 111 while the inclined surface 123 formed at a lower side of the side buttons 121 presses the pressing protrusion P1 protruding from the upper side of the airless pump P downward.

Figure 12:
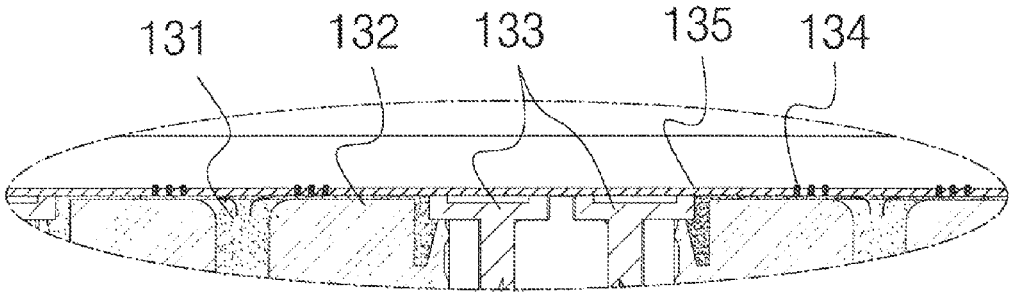
FIG. 12 is an enlarged view showing part b of FIG. 11.

Therefore, when the content transferring path in the airless pump is opened while the airless pump P moves downward, the cosmetic product contents in the temporary storage room P2 moves upward through the space 131 provided in the content guiding member 132, and as shown in FIG. 12, the cosmetic product contents moved upward by the high pressure primarily makes contact with the lower side surface of the mixing discharge member 134, moves and disperses to both sides, and then the cosmetic product contents are discharged to the outside through the multiple discharge holes 134.

Figure 13:
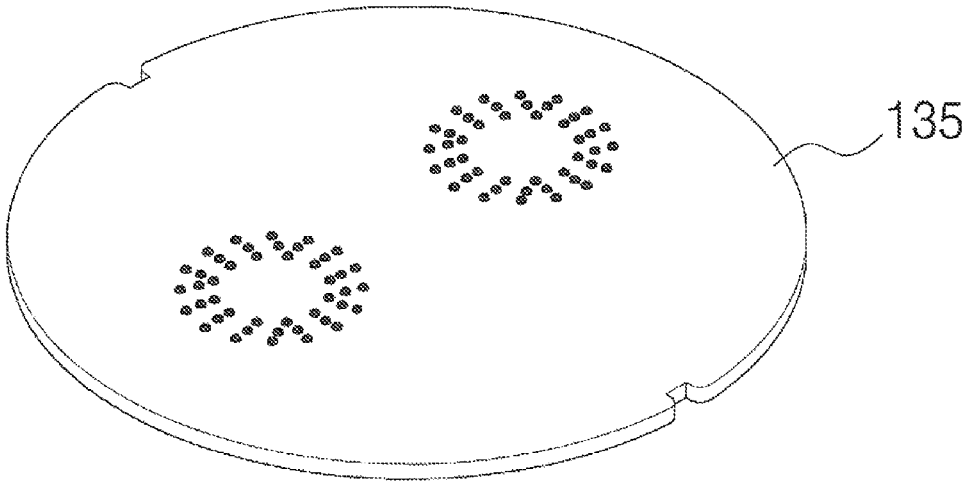
FIG. 13 is an enlarged perspective view showing the mixing member of the present invention.

In this case, the cosmetic product contents discharged through the discharge holes 134, as shown in FIG. 13, are discharged from both sides in a circular arrangement arranged by multiple cosmetic product water drops, so the user may mix the cosmetic product contents discharged to the two positions and wear the cosmetic product.

Therefore, when the two cosmetic product contents are discharged to the upper part of the mixing member 135 through the discharge holes 134 of the mixing member 135, the cosmetic product contents may be easily mixed and used.

Figure 14:
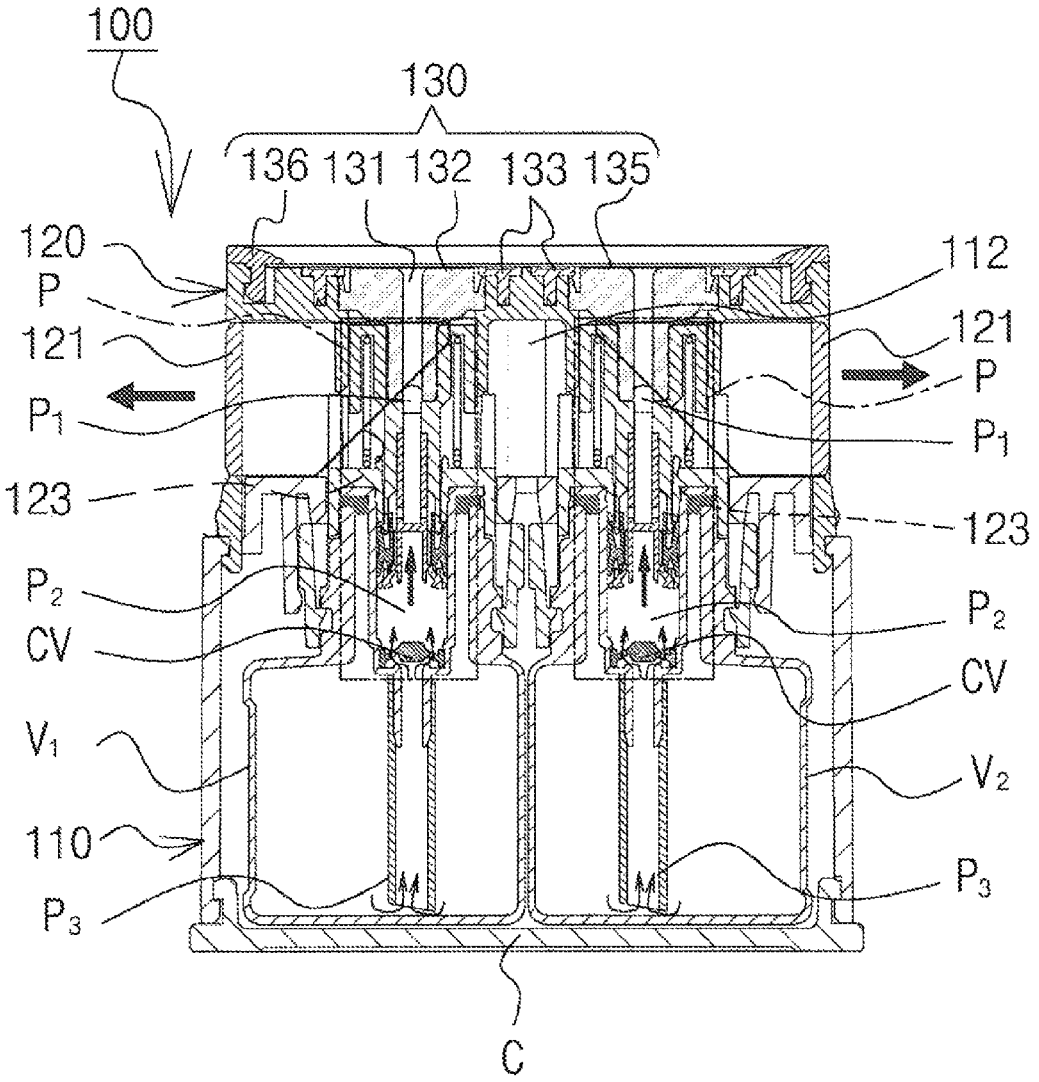
FIG. 14 is a sectional view showing an operation of an airless pump by a release of the pressurization of the side buttons of both sides provided in the present invention.

Then, as shown in FIG. 14, when the forces pressing both side buttons 121 are released, the air pump P is moved upward by the spring in the airless pump P and the pressing protrusion P1 pushes the inclined surface 123 of the side buttons 121 such that the side buttons 121 return to the original position.

In this case, simultaneously, the content transferring path is blocked by a piston packing when the piston rod stoves upward in the airless pump P, and accordingly, the cylinders in the first storage container V1 moves upward through a suction valve tube P3 when the check valve CV is opened when the vacuum pressure is generated in the cylinder in the airless pump P.

In addition, after all of the cosmetic product contents in the cosmetic container of the present invention are used, the cosmetic container of the present invention may be reused after replacing the first and second storage container V1 and V2 to new containers. The method of replacing the first and second storage containers V1 and V2 will be described. First, when the side button 121 is pressed after the lower cap C is removed from the container body 110, the inclined surface 123 of the side button 121 moves the pressing protrusion P1 of the airless pump P downward. In this case, because the lower cap C is removed from the lower side of the container body 110, the first and second storage containers V1 and V2 are also pushed downward and naturally break away according to the downward movement of the pressing protrusion P1.

When the first and second storage containers V1 and V2, which axe entirely used, are separated from the container body 110, new first and second storage containers V1 and V2 are inserted from the bottom of the container body 110 so that the first and second storage containers V1 and V2 are inserted and installed into the airless pump P.

Then, when the lower cap C is fastened to the lower part of the container body 110, the replacement of the first and second storage containers V1 and V2 is completed.

Figure 15:
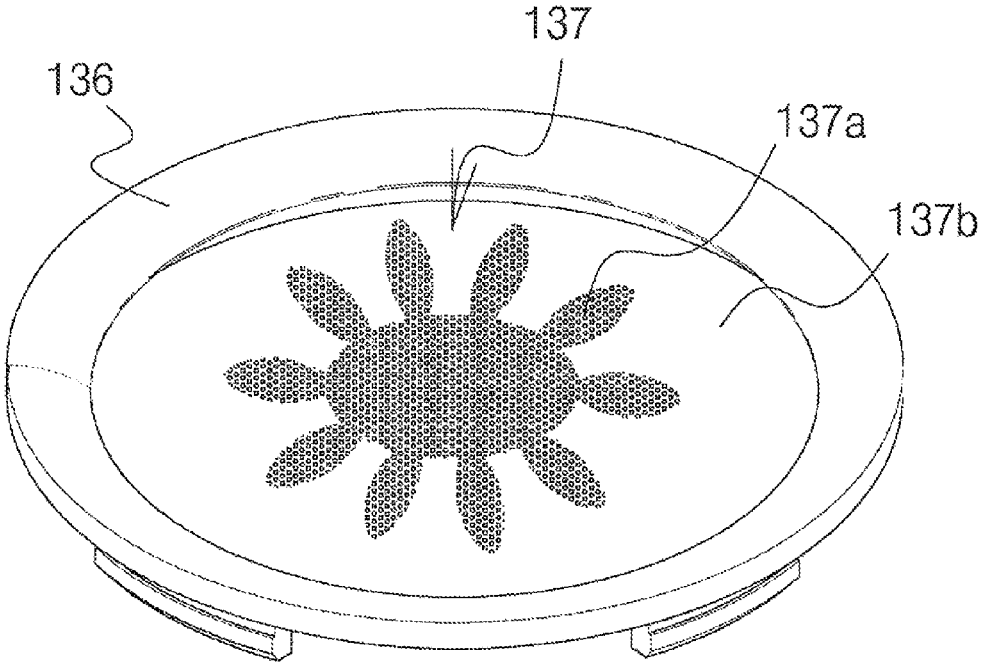
FIG. 15 is a perspective view showing another embodiment of the mixing member of the present invention.

Meanwhile, as another embodiment of the mixing member 135 of the present invention, as shown in FIG. 15, various patterns, for example, a flower in full bloom, may be provided in the mesh 137 coupled to the cover ring 136 through insert injection.

In other words, the cosmetic product contents are discharged in the discharge holes 137*a* provided in the pattern, in which the flower is in full bloom, and the discharge holes are blocked because paint 137*b* is coated in parts other than the pattern, so the cosmetic product contents are discharged through the discharge holes 137*a* provided in the pattern when discharging the cosmetic product contents to provide extravagance, thereby providing aesthetic impression to consumers.

While the present invention has been particularly shown and described with reference to various embodiments thereof, it should not be interpreted in any way to limit the scope of the present invention, and it will be understood by those of ordinary skill in the art that various substitutions, changes in form and alterations may be made therein without departing from the spirit and the scope of the present invention.

The invention claimed is:

1. An airless cosmetic container capable of discharging cosmetic product content in various patterns, the airless cosmetic container comprising:

first and second storage containers (V1 and V2), in which cosmetic product contents are accommodated;

an airless pump (P) provided at an opening part of the first and second storage containers (V1 and V2) to discharge the cosmetic product contents;

a container body (110), to which a lower cap (C) is coupled, to accommodate the first and second storage containers (V1 and V2);

a shoulder (120) coupled to an upper part of the container body (110) and having a button accommodating groove (122) to accommodate a side button (121) such that the side button (121) moves back and forth; and a content discharging device (130) provided at the shoulder (120) to primarily block the cosmetic product contents moving upward due to a high pressure by an operation of the airless pump (P) and guide the cosmetic product contents to multiple discharge holes (134) such that the cosmetic product contents are dispersedly discharged, wherein the content discharging device 130 includes:

a content guiding member (132) coupled to an upper end of the airless pump (P) and having a space (131), which includes a discharge path of the cosmetic product contents;

a sealing member (133) provided at an outer circumference of the content guiding member (132) and coupled to a rib (124) provided at the shoulder (120) to prevent the content guiding member (132) from breaking away and maintain a sealed state of the content;

a mixing member (135) to primarily block the cosmetic product contents discharged at a high pressure while maintaining a predetermined distance from an upper part of the content guiding member (132) and guide the cosmetic product content to multiple discharge holes (134) so that the cosmetic product content is discharged; and a cover ring (136) undercut and coupled to the shoulder (12) so that the mixing member (135) is fixed to an upper part of the shoulder (120).

2. The airless cosmetic container of claim 1, wherein the mixing member (135) includes metal or plastic.

3. The airless cosmetic container of claim 1, wherein the discharge holes (134) provided through the mixing member (135) include any one shape among a letter shape, a circular shape, a triangular shape, a pentagonal shape.

4. The airless cosmetic container of claim 1, further comprising a mesh (137) coupled to the cover ring (136) through insert injection to represent various patterns, in which the discharge holes (137*a*) are open in various patterns of the mesh (137) and a paint (137*b*) is coated on remaining parts of the mesh (137) to block the discharge holes.

5. The airless cosmetic container of claim 1, wherein the mesh (137) includes one of a screen and a fabric.

* * * * *